US005407770A

United States Patent [19]

Tomita et al.

[11] Patent Number: 5,407,770

[45] Date of Patent: Apr. 18, 1995

[54] CAPSULE TONER AND PROCESS FOR PRODUCING THE SAME

[75] Inventors: Kazafumi Tomita; Izuru Matsui; Koichi Takashima, all of Minami Ashigara, Japan

[73] Assignee: Fuji Xerox Co., Ltd., Tokyo, Japan

[21] Appl. No.: 167,026

[22] Filed: Dec. 16, 1993

[30] Foreign Application Priority Data

Dec. 21, 1992 [JP] Japan ..... 4-340582

[51] Int. Cl.[6] ..... G03G 9/093

[52] U.S. Cl. ..... 430/106.6; 430/109; 430/138; 428/402.21

[58] Field of Search ..... 430/106.6, 109, 138

[56] References Cited

U.S. PATENT DOCUMENTS 4,977,052 12/1990 Mikami ..... 430/138 X
5,147,744 9/1992 Sacripante et al. ..... 430/138 X
5,230,977 7/1993 Ohta ..... 430/106.6 X
5,304,448 4/1994 Keoshkerian et al. ..... 430/109

FOREIGN PATENT DOCUMENTS 57-179860 11/1982 Japan .
60-222866 11/1985 Japan .
225243 9/1988 Japan ..... 430/138
277043 11/1990 Japan ..... 430/138

OTHER PUBLICATIONS

"Text for 3rd Lecture of Introduction to Vehicle", Japan Colorant Association (Kanto Division), pp. 57–66 (1991).

"Polyurethane Resin Handbook", Nikkan Kogyo Shibun, pp. 71–98 (1987).

*Primary Examiner*—Roland Martin
*Attorney, Agent, or Firm*—Oliff & Berridge

[57] ABSTRACT

A capsule toner and a process for producing the same, the capsule toner comprising a core material containing a fixing component, an outer shell covering the core material, and an electrically conductive material adhered on the surface of the outer shell, the outer shell containing a polyurea resin and/or a polyurethane resin each obtained from an aliphatic polyisocyanate and an aromatic polyisocyanate. The capsule toner exhibits satisfactory charging properties while surely holding the fixing component inside to provide high quality images with excellent fixing properties.

4 Claims, No Drawings

CAPSULE TONER AND PROCESS FOR PRODUCING THE SAME

FIELD OF THE INVENTION

The present invention relates to a capsule toner for developing an electrostatic latent image, a magnetic latent image or the like, and a process for producing the same.

BACKGROUND OF THE INVENTION

Known fixing methods of an electrophotographically formed toner image include heat fixing and pressure fixing. Heat fixing requires a rise time for a fixing means to be heated up to a prescribed temperature after turning on the power and afterward energy for maintaining the fixing means at that temperature. Pressure fixing, on the other hand, requires neither a rise time nor heating energy. However, fixing strength obtained by pressure fixing is not sufficient so that high pressure should be applied for providing a toner image resistant to rubbing.

Capsule toners comprising a core material containing a fixing component, and a hard outer shell, which completely covers the core material, have been developed for solving the above-mentioned fixing problems. The outer shell of a capsule toner is destroyed on pressure application, and the fixing component runs off and is fixed on an image-receiving medium, such as paper and an OHP sheet.

When colorant particles or magnetic particles are exposed on the surface of the capsule toner, if used as an electrically conductive toner, the fluidity of the toner is deteriorated, making it difficult to form a chain on the development roll. Since the development of an electrically conductive toner is greatly affected by an electric charge induced on the toner chain, the reduction of the chain size makes it difficult for the induction electric charge to reach near the photoreceptor, resulting in the deterioration of the developability and the image quality.

When a large amount of magnetic particles are exposed on the surface of part of the toner particles forming a chain, an induction electric charge can be easily taken into the interior of the toner through magnetic particles on the surface of the toner particles. This results in the toner to be electrically charged, causing a fog in a non-image area. It is thus important to prevent the magnetic particles from coming out to the surface of the shell.

Further, the capsule toner comprises colorant particles or magnetic particles incorporated therein for the purpose of coloring or providing magnetic properties necessary for electrophotography. However, if a large amount of colorant particles or magnetic particles are incorporated in the core material in the capsule, the core material has so high a viscosity that the fixable substance does not flow out, resulting in the deterioration of the image fixability.

In order to improve the image fixability, it is preferred to cause a major proportion of the colorant particles or magnetic particles to be unevenly distributed in the shell. However, when the colorant particles or magnetic particles are exposed on the surface of the shell, the corresponding portion shows a resistivity change. Therefore, the electrical resistance of the toner varies with the extent to which these particles are exposed on the surface of the shell, giving a wide variation in the electrical resistance of the toner from lot to lot. Further, where the colorant particles or magnetic particles are hydrophilic, the electrical resistance of the toner greatly depends on the environmental conditions. Accordingly, from these standpoints also, it is important to prevent the colorant particles or magnetic particles from being exposed on the surface of the shell surface.

If the fixing component oozes out of the capsule during the preparation or storage of the toner, the toner particles will undergo agglomeration or remarkable reduction in fixability. Therefore, the outer shell needs to inhibit the penetration of the fixing component. However, the conventional capsule toner is not satisfactory.

For example, JP-A-57-179860 (the term "JP-A" as used herein means an "unexamined published Japanese patent application") discloses a capsule toner whose outer shell comprises polyurethane or polyurea prepared by the reaction of an isocyanate, water, and an amine or glycol component, and JP-A-60-222866 discloses a capsule toner whose outer shell comprises polyurethane or polyurea prepared by using one bifunctional isocyanate and at least one tri- or polyfunctional isocyanate.

However, in cases where the amount of magnetic particles to be incorporated is increased or where the shell thickness is decreased for capsule size reduction, the colorant particles or magnetic particles sought to have an increased concentration in the shell and be exposed on the shell surface. This causes an image deterioration or fogging, and also gives a wide variation of the electrical resistance of the toner from lot to lot. The electrical resistance of the toner greatly depends on the environmental conditions. Further, the colorant particles or magnetic particles pierce the shell, through which the fixing component, particularly a low-molecular-weight component would run out.

SUMMARY OF THE INVENTION

An object of the present invention to provide a capsule toner that maintains a good electrical conductivity of the capsule and surely retains a fixing component inside the shell of the capsule, providing an excellent image quality and fixability.

Another object of the present invention is to provide a process for producing the above-mentioned capsule toner.

Other objects and effects of the present invention will be apparent from the following description.

The present invention relates to a capsule toner comprising a core material containing a fixing component, an outer shell covering the core material, and an electrically conductive material adhered on the surface of the outer shell, the outer shell containing a polyurea resin and/or a polyurethane resin each obtained from at least an aliphatic polyisocyanate and an aromatic polyisocyanate.

The above-mentioned capsule toner includes an embodiment in which a capsule toner comprises a core material containing a fixing component, an outer shell covering the core material, and an electrically conductive material adhered on the surface of the shell, the outer shell containing a polyurea resin and/or a polyurethane resin each obtained from at least an aliphatic polyisocyanate and an aromatic polyisocyanate, wherein the outer shell contains colorant particles and/or magnetic particles.

The present invention also relates to a process for producing the above capsule toner, the process comprising (a) a step of dispersing at least colorant particles and/or magnetic particles, a fixing component, and an oily component containing an aliphatic polyisocyanate and an aromatic polyisocyanate in a solvent, (b) a step of polymerizing the dispersed particles to form an outer shell containing a polyurea resin and/or a polyurethane resin, and (c) a step of adhering an electrically conductive material on the surface of the outer shell.

DETAILED DESCRIPTION OF THE INVENTION

If a capsule shell is formed by using an aliphatic polyisocyanate having a low reaction rate as a sole isocyanate component, colorant particles or magnetic particles are easily incorporated into the shell and pierce the shell, resulting in a failure of surely holding a fixing component inside the shell. If, on the other hand, a capsule shell is formed by using an aromatic polyisocyanate having a high reaction rate as a sole isocyanate component, colorant particles or magnetic particles are apt to be incorporated into the core material but not into the shell. It follows that the viscosity of the core material considerably increases, failing to let the fixing component run off even on pressure application, resulting in poor fixing.

The above problems are now solved by the present invention. According to the present invention, it is considered that an aromatic polyisocyanate having a high reaction rate first undergoes reaction to form an outermost layer, and then a slow-reacting aliphatic polyisocyanate forms an inner layer while taking in colorant particles or magnetic particles. Thus, the colorant particles or magnetic particles are never exposed on the shell surface, and a fixing component can be surely confined within the outer shell. Further, the electrical conductivity of the capsule toner can be improved. By adding an electrically conductive material, a capsule toner is capable of providing images with improved quality and improved fixing strength.

The terminology "aliphatic polyisocyanates" as used herein means polyisocyanates whose isocyanate groups are not bonded directly to an aromatic ring. Specific examples of the aliphatic polyisocyanates include trimethylene diisocyanate, hexamethylene diisocyanate, 2,2,4-trimethylhexane diisocyanate, cyclohexane-1,2-diisocyanate, 1-methylcyclohexane-2,4-diisocyanate, isophorone diisocyanate, cyclohexylmethane-4,4-diisocyanate, lysine diisocyanate, xylylene diisocyanate, m-phenylenebis(isopropylisocyanate), and dicyclohexylmethane diisocyanate. Among them preferred are xylylene diisocyanate, hexamethylene diisocyanate, and dicyclohexylmethane diisocyanate. These aliphatic isocyanates may be used either individually or in combination thereof.

The terminology "aromatic polyisocyanates" as used herein means polyisocyanates whose isocyanate groups are bonded directly to an aromatic ring. Specific examples of the aromatic polyisocyanates include phenylene diisocyanate, tolylene diisocyanate, naphthalene-1,4-diisocyanate, naphthalene-1,5-diisocyanate, toluidine diisocyanate, diphenylmethane diisocyanate, 3,3'-dimethyldiphenylmethane4,4'-diisocyanate, 3,3'-dimethoxydiphenylmethane4,4'-diisocyanate, diphenyl ether-4,4'-diisocyanate, 4,4'-dimethyldiphenylmethane-2,2',5,5'-tetraisocyanate, and triphenylmethane-4,4 ', 4''-triisocyanate. Preferred of them are diphenylmethane diisocyanate, triphenylmethane triisocyanate, and tolylene diisocyanate. These aromatic polyisocyanates may be used either individually or in combination thereof.

The aliphatic isocyanate is generally used in an amount of from 2 to 95% by weight, preferably from 5 to 85% by weight, and more preferably from 55 to 85% by weight, based on the total isocyanate components.

Examples of the substance which reacts with the foregoing polyisocyanate to produce a polyurethane resin or polyurea resin include water, and the following polyamines and polyols. Specific examples of such a substance include polyamines such as ethylenediamine, hexamethylenediamine, diethylenetriamine, iminopropylamine, triethylenetetramine, trimethylenediamine, tetramethylenediamine, pentamethylenediamine, p-phenylenediamine, m-phenylenediamine, 2-hydroxytrimethylenediamine, diethylaminopropylamine, tetraethylenepentamine, xylylenediamine, diphenylmethanediamine, piperazine, 2,5-dimethylpiperazine and polyoxydialkyleneamine, diols such as catechol, resorcinol, hydroquinone, dihydroxymethylbenzene, naphthalenediol, ethylene glycol, 1,4-butanediol, propylene glycol, butylene glycol and hexamethylene glycol, and triols such as glycerin, trimethylol propane, trimethylolethane and 1,2,6-hexanetriol. Particularly preferred of those reactants include diethylenetriamine, triethylenetetramine and tetraethylenepentamine.

The preparation of the capsule toner may be preferably effected by conventional interfacial polymerization methods. For example, a method can be used which comprises dispersing an oily mixture of a fixing component, magnetic particles, colorant particles, polyisocyanates, etc. in a dispersing medium such as water with a dispersant and a mechanical means, and then adding a polyol or polyamine in the dispersing medium to the oily mixture to effect interfacial polymerization to form microcapsules. In an alternate method, capsules which have been previously formed with a monomer contained therein are subjected to interfacial polymerization of the monomer to form a fixing component. In the interfacial polymerization method, a low boiling solvent may be added to the system for the purpose of adjusting the viscosity of the oily mixture or the like purposes.

Examples of the fixing component include a styrene polymer, a styrene-butadiene copolymer, an epoxy resin, polyester, rubber, polyvinylpyrrolidone, polyamide, a coumarone-indene copolymer, a methyl vinyl ether-maleic anhydride copolymer, an amino resin, polyurethane, polyurea, a polymer or copolymer of acrylic ester or methacrylic ester, a copolymer of acrylic acid or methacrylic acid with acrylic ester or methacrylic ester, polyvinyl acetate, and polyvinyl chloride. Particularly preferred among these resins are a styrene polymer, and a polymer or copolymer of acrylic ester or methacrylic ester. These resins may be used singly or in admixture. Among these resins, those which are not liquid at room temperature, i.e., have no fluidity are preferably used with a plasticizer or in the form of solution or dispersion in a high boiling point solvent.

Examples of the plasticizer which can be used in the present invention include ester phosphate such as tributyl phosphate and triphenyl phosphate, ester phthalate such as dibutyl phthalate and di-n-octyl phthalate, aliphatic monobasic ester such as butyl oleate and ester glycerinmonooleate, aliphatic dibasic ester such as di-n-hexyl adipate and dibutyl sebacate, divalent alcohol ester such as diethyleneglycol dibenzoate and triethyleneglycol di-2-ethylbutyrate, ester hydroxycarboxylate such as butylphthalylbutyl glycolate and tributyl acetylcitrate, chlorinated paraffin, chlorinated biphenyl, 2-hintrobiphenyl, dinonyl naphthalene, o-toluenesulfone ethylamide, p-toluenesulfone ethylamide, camphor, and methyl abietate.

Examples of the high boiling point solvent to be used in the present invention include ester phthalate such as diethyl phthalate and dibutyl phthalate, aliphatic dicarboxylic ester such as diethyl malonate and dimethyl oxalate, ester phosphate such as tricresyl phosphate and trixylyl phosphate, ester citrate such as o-acetyltriethyl citrate and tributyl citrate, ester benzoate such as butyl benzoate and hexyl benzoate, alkyl naphthalene such as methyl naphthalene, monoisopropyl naphthalene and diisopropyl naphthalene, alkyldiphenylether such as o-, m- and p-methyldiphenylether, higher aliphatic or aromatic sulfonic amide compound such as N,N-dimethyllauroamide and N-butylbenzenesulfonamide, ester trimellitate such as trioctyl trimellitate, diarylalkane such as diarylmethane (e.g., dimethylphenylphenylmethane) and diarylethane (e.g., 1-phenyl-l-methylphenylethane, 1-dimethylphenyl1-phenylethane, 1-ethylphenyl-1-phenylethane), saturated aliphatic hydrocarbon, unsaturated aliphatic hydrocarbon, and chlorinated paraffins.

The magnetic particles may be incorporated in the core material or the outer shell. Examples of the magnetic particles include magnetite, ferrite, metals such as cobalt, iron, nickel, etc., and alloys thereof.

Examples of the colorant particles which can be used in the present invention include inorganic pigments such as carbon black, red iron oxide, Prussian blue and titanium oxide, azo pigments such as fast yellow, diazo yellow, pyrazolone red, chelate red, brilliant carmine and parabrown, phthalocyanine pigments such as copper phthalocyanine and metal-free phthalocyanine, and condensed polycyclic pigments such as flavanthrone yellow, dibromoanthrone orange, perylene red, quinacridone red and dioxazine violet. Dispersed dyes, oil-soluble dyes, etc. may be used. Alternatively, the above-mentioned magnetic powders may be used as the colorant.

The amount of the colorant is generally from 10 to 75% by weight, preferably from 35 to 65% by weight, based on the total amount of the toner in the case where the colorant is magnetic powder. It is generally from 0.1 to 20% by weight, preferably from 0.5 to 10% by weight, based on the total amount of the toner in the case where the colorant is a non-magnetic pigment.

The viscosity of the core material needs to be low enough to cause the fixing component to flow out from the capsule when the capsule is fixed under external pressure. 20% by weight or more, preferably 50% by weight or more of the total amount of the colorant particles or magnetic particles are preferably present in the outer shell.

The colorant particles or magnetic particles may be subjected to surface treatment with a coupling agent such as silane coupling agent and titanate coupling agent or an oil-insoluble surface active agent or surface coating with an acrylic resin, styrene resin, epoxy resin or the like so that they can be easily incorporated in the shell.

The low boiling point solvent may be a solvent having a boiling point of not higher than 100° C. Specific examples of such a low boiling point solvent include n-pentane, methylene chloride, ethylene chloride, carbon disulfide, acetone, methyl acetate, chloroform, methyl alcohol, ethyl alcohol, tetrahydrofuran, n-hexane, carbon tetrachloride, methyl ethyl ketone, benzene, ethyl ether, and petroleum ether. These low boiling point solvents may be used singly or in admixture.

Examples of the dispersant which can be used in the present invention include water-soluble high molecular weight compounds such as gelatin, gum arabic, sodium arginate, casein, methyl cellulose, carboxymethyl cellulose, hydroxyethyl cellulose, hydroxypropylmethyl cellulose, polyacrylic acid, vinylbenzenesulfonic acid copolymer, starch and polyvinyl alcohol, and finely divided particles of inorganic materials such as colloidal silica, colloidal alumina, tribasic calcium phosphate, aluminum hydroxide, ferric hydroxide, calcium carbonate, barium carbonate, barium sulfate and bentonite. The dispersing medium or oily mixture may contain a surface active agent.

Examples of such a surface active agent include anionic surface active agents such as aliphatic soap, N-acylamino acid and salts thereof, alkylethercarboxylate, acylated peptide, alkylbenzenesulfonate, alkylnaphthalenesulfonate, polycondensate of naphthalenesulfonate with formalin, ester dialkylsulfosuccinate, alkylsulfonacetate, α-olefinsulfonate, N-acylmethyltaurine, sulfated oil, ester of higher alcohol with sulfuric acid, ester of secondary alcohol with sulfuric acid, alkylether sulfate, secondary alcohol ethoxy sulfate, polyoxyethylene alkylphenyl ether sulfate, monoglysulfate, sulfuric ester of aliphatic alkylolamide, alkyletherphosphoric ester and alkylphosphoric ester, cationic surface active agents such as aliphatic amine salt, aliphatic quaternary ammonium salt, benzalconium salt, chlorinated benzetonium, pyridinium salt and imidazolium salt, amphoteric surface active agents such as carboxybetaine, aminocarboxylate, imidazoliniumbetaine and lecithin, nonionic surface active agents such as polyoxyethylene alkyl ether, single chain length polyoxyethylene alkyl ether, ether of polyoxyethylene with secondary alcohol, polyoxyethylene alkylphenyl ether, polyoxyethylene sterol ether, polyoxyethylenelanolin derivative, ethylene oxide derivative of alkylphenolformalin condensate, polyoxyethylene polyoxypropylene block polymer, polyoxyethylene polyoxypropylene alkyl ether, aliphatic ester of polyoxyethyleneglycerin, polyoxyethylene castor oil, hardened castor oil, aliphatic ester of polyoxyethylenesorbitan, aliphatic ester of polyoxyethylenesorbitol, aliphatic ester of polyethylene glycol, aliphatic monoglyceride, aliphatic ester of polyglycerin, aliphatic ester of sorbitan, aliphatic ester of propylene glycol, aliphatic ester of cane sugar, aliphatic alkanolamide, aliphatic amide of polyoxyethylene, polyoxyethylene alkylamide and alkylamine oxide, and fluorine surface active agents. These surface active agents may be used singly or in admixture.

The dispersing medium may generally be water. Alternatively, ethylene glycol, glycerin, butyl alcohol, octyl alcohol, and mixtures of water and these solvents may be used.

The particles of the capsule toner of the present invention preferably have an average particle size of from 1 to 30 μm, and more preferably from 2 to 18 μm.

In order to reduce the electrical resistivity of the toner to obtain an electrically conductive toner, an electrically conductive material is added to be adhered on the surface of the toner particles. Examples of the electrically conductive material include finely divided particles of gold, platinum, silver, copper, nickel, tin, aluminum, palladium, iron, lead, zinc, carbon black, graphite, molybdenum sulfide, zinc oxide, titanium oxide, tin oxide, aluminum oxide, indium oxide, silicon oxide, magnesium oxide, barium oxide, molybdenum oxide, and composite oxide thereof. Alternatively, a metal oxide containing a small amount of heteroatoms may be used. For example, aluminum or indium may be contained in zinc oxide, niobium or tantalum may be contained in titanium oxide, and antimony, niobium or halogen atom may be contained in tin oxide. Among the above electrically conductive materials, carbon black, graphite, and tin oxide are preferred. Tin oxide may be doped with a small amount of metals such as antimony and may be a mixture or solid solution of SnO and $SnO_2$. The toner in which the electrically conductive particles are to be contained may be insulating or electrically conductive itself.

The amount of the electrically conductive material is generally from 0.05 to 10% by weight, preferably from 0.1 to 5% by weight, based on the total amount of the toner.

The electrical resistance of the toner is measured as follows. Specifically, a teflon cylinder with an inner diameter of 3 mm having an electrode on the bottom thereof is lightly filled with a small amount of a toner. An opposing electrode is inserted into the cylinder from the upper portion thereof. The opposing electrode is then pressed under a load of about 100 g. The amount of the toner to be used is adjusted such that the compressed height of the toner is about 1 mm. A voltage is then applied across the two electrodes. The resistivity of the toner is determined from electric current flown after 1 minute. The resistivity of the toner under an electric field of $10^2$ V/cm is determined by interpolation of the resistivity values with the voltage changed by several stages with an electrode inserted. The electrically-conductive toner as defined herein means a toner having a resistivity of $10^{12}$ Ωcm or less under an electric field of $10^2$ V/cm.

In the case where the simultaneous pressure transfer and fixing process is effected, lubricant particles are preferably attached to the surface of the capsule toner particles.

Examples of the lubricant include an aliphatic acid, a metallic salt of aliphatic acid, an aliphatic alcohol, an aliphatic amide, an aliphatic bisamide, an aliphatic ester, and mixtures of two or more thereof.

Examples of the aliphatic acid include lauric acid, myristic acid, stearic acid, oleic acid, linoleic acid, ricinoleic acid, arachic acid, behenic acid, lignoceric acid, ceracholeic acid, and mixtures thereof.

Examples of the metallic salt of aliphatic acid include salts of stearic acid with metal such as zinc, cadmium, barium, lead, iron, nickel, cobalt, copper, aluminum and magnesium, dibasic lead stearate, salts of oleic acid with metal such as zinc, magnesium, iron, cobalt, copper, lead and calcium, salts of palmitic acid with metal such as aluminum and calcium, lead caprinate, lead caproate, zinc linolenate, cobalt linolenate, calcium ricinoleate, salts of ricinoleic acid with metal such as zinc and cadmium, and mixtures thereof.

Examples of the aliphatic alcohol include a monovalent alcohol or a polyvalent alcohol. Specific examples of such an aliphatic alcohol include lauryl alcohol, myristyl alcohol, palmityl alcohol, stearyl alcohol, arachyl alcohol, and behenyl alcohol.

Examples of the aliphatic amide include lauric amide, myristic amide, palmitic amide, stearic amide, arachic amide, behenic amide, oleic amide, linoleic amide, linoleic amide, cadleic amide, erucic amide, and ceracholeic amide.

Examples of the aliphatic bisamide include bislauric amide, bismyristic amide, bispalmitic amide, and bisstearic amide.

Examples of the aliphatic ester include an ester of aliphatic acid with monovalent alcohol, an ester of aliphatic acid with polyvalent alcohol, and a partial ester of aliphatic acid with polyvalent alcohol.

The lubricant particles generally have a particle size of from 0.1 to 30 μm, and preferably from 0.5 to 20 μm.

The addition of the finely divided lubricant particles and electrically conductive particles to the toner particles can be accomplished by any known method. These finely divided particles may be added to the toner particles in the form of slurry, and then dried. Alternatively, these finely divided particles may be added to the toner particles in the form of dried powder. Further, these finely divided particles in the form of slurry may be sprayed over the dried powder of toner particles so that they are dried. In order to add the finely divided lubricant particles in the form of dried powder, it is necessary that they be previously dried.

Examples of the dryer include conventional dryers, such as a ventilation dryer, a spray dryer, a rotary dryer, an airborne dryer, a fluidized bed dryer, a heat transmission dryer, a freeze dryer, etc.

Examples of the means of solid mixing include any of various rotary vessel type mixers, fixed vessel type mixers, and mixers of the type of composite thereof.

The lubricant particles are generally used in an amount of from 0.1 to 10 % by weight, preferably from 0.2 to 5 % by weight, based on the total amount of the toner.

The present invention will be further described in the following examples, but the present invention should not be construed as being limited thereto.

EXAMPLE 1

Preparation of Capsule Particles

Into a 2-l polyethylene container were charged 120 g of lauryl methacrylate (GE-410, available from Mitsubishi Gas Chemical Company, Inc.), 3.0 g of azobisisobutylonitrile (ABN-R, available from Nippon Hydrazine Kogyo K.K.), 40 g of xylylenediisocyanate as an aliphatic isocyanate (Takenate 500 available from Takeda Chemical Industries, Ltd.), 10 g of diphenylmethanediisocyanate as an aromatic isocyanate (Isonate 143L available from Mitsubishi Kasei Dow K.K.), and 15 g of dichloromethane. The ingredients were then thoroughly stirred by means of a polytrone homogenizer (available from Kinemachika K.K.). To the mixture was then added 300 g of a magnetic powder of triiron tetraoxide (EPT-1000, available from Toda Kogyo K.K.). The mixture was then vigorously stirred by means of a polytrone homogenizer (Kinemachika K.K.) to disperse the magnetic powder therein.

To the dispersion was then added 1 kg of a 0.15 % aqueous solution of a polyvinyl alcohol (PVA220, available from Kuraray Co., Ltd.). The mixture was then stirred at 10,000 r.p.m. for 1 minute to obtain an O/W emulsion containing oil droplets having an average particle diameter of 12 μm. This emulsion was then immediately transferred into a 3-l flask. To the emulsion was then added 100 g of a 20% aqueous solution of diethylenetriamine (TEXLIN DETA, available Mitsubishi Texaco Chemical K.K.). The mixture was then stirred for 1 hour by means of an agitator equipped with propeller blades to form a shell on the surface of the oil droplets. Thus, capsule particles were obtained.

The suspension of capsule particles was then heated to a temperature of 90° C. at a rate of 1° C./min. over an oil bath, and then further heated for 5 hours so that the lauryl methacrylate monomer in the capsule particles was polymerized. After allowed to cool, the suspension of capsule particles was transferred into a 4-l beaker, and then diluted with an ion-exchanged water with stirring to make 4 l, followed by allowed to stand. After the capsule particles were sedimented, the supernatant fraction was removed. This procedure was repeated further seven times to wash the capsule particles. The capsule particles were then passed through a 75-μm mesh sieve to remove coarse grains. To the resulting suspension of capsule particles was then added an ion-exchanged water to adjust the solid concentration of the suspension to 20%. It was then dried in a spray dryer (available from Yamato Kagaku K.K.) with an inlet temperature of 180° C. to obtain dried powder of capsule particles.

Wet-pulverizing of Lubricant Particles

Into a 300-ml ball mill were charged 100 g of an ion-exchanged water, 10 g of zinc stearate (ZnSt, available from Nitto Kasei K.K.), 1 g of carbon black (Vulcan PF available from Cabot Co.), and steal balls. The mixture was then pulverized for 3 days. The resulting slurry was then freeze-dried to obtain dried powder.

Preparation of Toner

To 400 g of the foregoing capsule particles were added 4 g of carbon black (Vulcan P, available from Cabot Co.) which had been thoroughly crushed by means of a Henschel mixer (available from Mitsui Miike Kakoki K.K.) and 6 g of the foregoing lubricant particles (zinc stearate). The mixture was then stirred by means of a twin-cylinder mixer for 6 hours, and then passed through a 75-μm mesh sieve to obtain a toner.

Evaluation

The toner thus obtained was then measured for electrical resistance. The result was 3.2×103 Ωcm.

The toner was subjected to a printing test in Type 4075 printer available from Xerox Corporation. As a result, the toner provided excellent image quality and fixability.

COMPARATIVE EXAMPLE 1

A capsule toner was prepared in the same manner as in Example 1 except that 50 g of xylylenediisocyanate (Takenate 500 available from Takeda Chemical Industries, Ltd.) was used instead of the combination of 40 g of xylylenediisocyanate (Takenate 500 available from Takeda Chemical Industries, Ltd.) and 10 g of diphenylmethanedissocyanate (Isonate 143L available from Mitsubishi Chemical Industries, Ltd.).

The toner thus obtained had been agglomerated. The capsule toner was measured for electrical resistance in the same manner as in Example 1. The result was 2.5×103 Ωcm. The toner was then subjected to a printing test in Type 4075 printer available from Xerox Corporation. As a result, the toner could not provide any image.

EXAMPLE 2

Preparation of Capsule Particles 40 g of a copolymer made of 50 parts by weight of lauryl methacrylate and 50 parts by weight of styrene (molecular weight: $8\times10^4$; glass transition temperature Tg: −10° C.) was dissolved in a mixture of 60 g of an aliphatic saturated hydrocarbon solvent (Isopar H available from Exxon Chemical Co.) and 45 g of ethyl acetate. To the solution was then added 120 g of a magnetic powder (EPT-1000 available from Toda Kogyo K.K.). The mixture was then subjected to dispersion by means of a ball mill for 20 hours. 200 g of the dispersion was then thoroughly mixed with 25 g of hexamethylenediisocyanate (Desmodur H available from Sumitomo Beyer Urethane Co.) as an aliphatic isocyanate, 5 g of toluenediisocyanate (Takenate D204EA available from Takeda Chemical Industries, Ltd.) as an aromatic isocyanate, and 24 g of ethyl acetate to prepare Composition A.

Separately, 10 g of hydroxypropyl methylcellulose (Metrose 65SH50, produced by Shin-etsu Chemical Co., Ltd.) was dissolved in 200 g of ion-exchanged water. The solution was then cooled to 5° C. to obtain Composition B.

Composition A was gradually added to Composition B while the latter was stirred by means of an emulsifier (Autohomomixer produced by Tokushu Kako K.K.). Thus, an O/W type emulsion comprising oil drops having an average diameter of about 7 μm was obtained.

The emulsion was then stirred at 400 r.p.m. by means of an agitator equipped with propeller blades (Three-one motor, produced by Shinto Kagaku K.K.) instead of the emulsifier. After 10 minutes, to the emulsion was added dropwise 200 g of a 5% aqueous solution of ethylenediamine. After the completion of dropwise addition, capsulization reaction was effected for 3 hours while ethyl acetate was removed by evaporation at a temperature of 60° C. After the completion of reaction, the reaction mixture was poured into 2 l of ion-exchanged water. The mixture was thoroughly stirred and then allowed to stand. After the sedimentation of capsule particles, the supernatant fraction was removed. This procedure was repeated further seven times to wash the capsule particles. The capsule particles were then passed through a 75-μm mesh sieve to remove coarse grains. To the resulting suspension of capsule particles was then added an ion-exchanged water to adjust the solid concentration of the suspension to 20%. It was then dried in a spray dryer (available from Yamato Kagaku K.K.) with an inlet temperature of 180° C. to obtain dried powder of capsule particles.

Wet-pulverizing of Lubricant Particles

Into a 300-ml ball mill were charged 100 g of an ion-exchanged water, 10 g of zinc stearate (ZnSt, available from Nitto Kasei K.K.), 1 g of sodium dodecylsulfate, and steal balls. The mixture was then pulverized for 3 days. The resulting slurry was then freeze-dried to obtain dried powder.

Preparation of Toner

To 100 g of the foregoing capsule particles were added 2 g of carbon black (Vulcan P, available from Cabot Co.) which had been thoroughly crushed by means of a Henschel mixer (available from Mitsui Miike Kakoki K.K.) and 3 g of the foregoing lubricant particles (zinc stearate). The mixture was then stirred by means of a twin-cylinder mixer for 6 hours, and then passed through a 75-μm mesh sieve to obtain a toner.

Evaluation

The toner thus obtained was then measured for electrical resistance. The result was 3.4×103 Ωcm. The capsule toner thus obtained was then subjected to thermogravimetry. As a result, it was confirmed that the toner contained the aliphatic saturated hydrocarbon solvent (Isopar H available from Exxon Chemical Co.) in the same amount as charged.

The toner was subjected to a printing test in Type 4075 printer available from Xerox Corporation. As a result, the toner provided excellent image quality and fixability.

COMPARATIVE EXAMPLE 2

A capsule toner was prepared in the same manner as in Example 2 except that 30 g of hexamethylenediisocyanate (Desmodur H available from Sumitomo Beyer Urethane K.K.) was used instead of the combination of 25 g of hexamethylenediisocyanate (Desmodur H available from Sumitomo Beyer Urethane K.K.) and 5 g of toluenediisocyanate (Takenate D204EA available from Takeda Chemical Industries, Ltd.).

The capsule toner thus obtained was measured for electrical resistance in the same manner as in Example 2. The result was 2.3×103 Ωcm. The capsule toner was then subjected to thermogravimetry. As a result, it was confirmed that the toner was free of the aliphatic saturated hydrocarbon solvent (Isopar H available from Exxon Chemical Co.).

The toner was subjected to a printing test in Type 4075 printer available from Xerox Corporation. When the resulting fixed image was rubbed, the toner image was peeled off, showing a poor fixability.

As described in the foregoing, the present invention makes it possible to maintain a good electrical conductivity without causing colorant particles or magnetic particles to be exposed to the surface of the capsule, thus providing an image having good quality and fixability.

While the invention has been described in detail and with reference to specific embodiments thereof, it will be apparent to one skilled in the art that various changes and modifications can be made therein without departing from the spirit and scope thereof.

What is claimed is:

1. A capsule toner comprising a core material containing a fixing component, an outer shell covering said core material, and an electrically conductive material adhered on the surface of said outer shell, said outer shell containing a polyurea resin and/or polyurethane resin each obtained from at least an aliphatic polyisocyanate and an aromatic polyisocyanate.

2. A capsule toner as claimed in claim 1, wherein said outer shell contains colorant particles and/or magnetic particles.

3. A capsule toner as claimed in claim 2, wherein said colorant particles and/or magnetic particles are not exposed on the surface of said outer shell.

4. A capsule toner as claimed in claim 1, wherein the amount of said aliphatic isocyanate is from 2 to 95% by weight based on the total amount of said aliphatic isocyanate and said aromatic isocyanate.

* * * * *